US006966097B2

(12) United States Patent
Engel et al.

(10) Patent No.: US 6,966,097 B2
(45) Date of Patent: Nov. 22, 2005

(54) STREET SWEEPER WITH DUST CONTROL

(75) Inventors: Gregory J. Engel, Plymouth, MN (US); Theodore J. Olsonoski, Rogers, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/236,095

(22) Filed: Sep. 6, 2002

(65) Prior Publication Data

US 2004/0045123 A1 Mar. 11, 2004

(51) Int. Cl.[7] ..... A47L 9/20

(52) U.S. Cl. ..... 15/348; 15/349; 15/352; 15/340.4

(58) Field of Search ..... 15/347, 340.4, 15/348, 349, 352

(56) References Cited

U.S. PATENT DOCUMENTS

| | | | | | |
|---|---|---|---|---|---|
| 1,610,119 | A | * | 12/1926 | Butler | 15/348 |
| 3,008,542 | A | | 10/1959 | Steele | |
| 3,160,908 | A | * | 12/1964 | Peabody et al. | 15/352 |
| 3,173,777 | A | * | 3/1965 | Tamny | 15/347 |
| 3,186,021 | A | * | 6/1965 | Krier et al. | 15/340.4 |
| 3,304,572 | A | * | 2/1967 | Wendel | 15/352 |
| 3,484,889 | A | * | 12/1969 | McCandless | 15/340.4 |
| 3,604,051 | A | | 9/1971 | Wendel et al. | 15/352 |
| 3,639,940 | A | * | 2/1972 | Carlson et al. | 15/352 |
| 3,756,416 | A | | 9/1973 | Wood | |
| 3,792,569 | A | | 2/1974 | Carlson et al. | 55/288 |
| 3,881,215 | A | | 5/1975 | Krier et al. | 15/347 |
| 3,926,596 | A | | 12/1975 | Coleman | 15/352 |
| 4,017,281 | A | | 4/1977 | Johnstone | 15/352 |
| 4,032,307 | A | * | 6/1977 | Sommerfeld | 15/352 |
| 4,578,840 | A | | 4/1986 | Pausch | 15/352 |
| 4,660,248 | A | | 4/1987 | Young | 15/346 |
| 4,759,781 | A | | 7/1988 | Olson | |
| 4,903,368 | A | * | 2/1990 | Duthie et al. | 15/340.4 |
| 5,006,136 | A | | 4/1991 | Wetter | 55/290 |
| 5,303,448 | A | * | 4/1994 | Hennessey et al. | 15/347 |
| 6,192,542 | B1 | * | 2/2001 | Frederick et al. | 15/84 |
| 6,195,836 | B1 | * | 3/2001 | Vanderlinden | 15/340.3 |
| 6,195,837 | B1 | * | 3/2001 | Vanderlinden | 15/348 |
| 2004/0020003 | A1 | * | 2/2004 | Strauser | 15/340.4 |

FOREIGN PATENT DOCUMENTS

DE 1256241 * 12/1967

OTHER PUBLICATIONS

Tennant Company, The Sentinel ™Power Sweeper marketing brochure (6 pages).

* cited by examiner

*Primary Examiner*—Theresa T. Snider
(74) *Attorney, Agent, or Firm*—Altera Law Group, LLC

(57) ABSTRACT

Street sweeper having dust control from two or more cleaning heads with one air source where one fan provides vacuum for a centrally located rotating broom which is surrounded by a vacuumized chamber and for a gutter broom which is surrounded by a vacuumized chamber. A plenum having a unique valving system and a filter shaker mechanism provides for filter cleaning and for a dirt and debris path from the plenum to a hopper bottom during filter cleaning.

24 Claims, 10 Drawing Sheets

STREET SWEEPER WITH DUST CONTROL

CROSS REFERENCES TO RELATED APPLICATIONS

None.

BACKGROUND OF THE INVENTION

1. Field of the Invention

The present invention pertains to a street sweeper, and more particularly, to dust control from two or more cleaning heads with one air source.

2. Description of the Prior Art

Prior art dust control systems for road sweepers frequently include the use of water which wets the debris and dirt on the road surface to prevent dust from becoming airborne during the sweeping process. In such systems, water must be provided at various sweeper locations, such as, but not limited to, the main rotary broom and the gutter brooms. Water systems often just wet down debris and dirt whereby the wetted debris and dirt may still reside on the wetted roadway after sweeping rather than having been carried into the conveyor or hopper. The use of vacuum systems instead of water systems to carry off generated airborne dust is often desirable in that no wetted debris or dirt is presented to be left behind after sweeping. Vacuum systems generally use a separate dedicated fan to draw dust from the region of the main rotary broom and a separate dedicated fan to draw dust from the region of the gutter brooms. The use of separate and dedicated fans results in excessive space being occupied and adds expense to the fabrication processes. The use of separate and dedicated fans can also produce a flow problem where the vacuum produced by one fan may interfere or conflict with the vacuum of another fan when entering a common chamber or plenum.

Another problem encountered in dry dust control systems is that of clogging of a filter located prior to the fan. Filter clogging is detrimental to the removal of dust before discharging air from the fan to the atmosphere and can slow and hinder the vacuuming process significantly. Cleaning or exchanging a filter can be a laborious and time-consuming process resulting in poor overall efficiency.

SUMMARY OF THE INVENTION

The general purpose of the present invention is to provide a street sweeper having dust control from two or more cleaning heads with one air vacuum source in a road sweeper, as well as a dust filtration system which can be readily cleaned on site without the removal of filtration components and without other extraordinary measures. The present invention can be incorporated for use along a substantially planar surface, such as a road where the term road can mean any surface within a manufacturing facility, such as a tiled or concrete paved surface or the like, and can also be utilized along a common roadway. In the present invention, a single fan is mounted to a plenum in the upper region of a truck-mounted hopper to provide vacuum for dust control. A filter mechanism and a filter shaker mechanism mount just below the fan in the upper region of the plenum. The bottom of the plenum includes an orificed plenum array having a plurality of automatic flexible airflow operated flap valves which are closed during the sweeping operation to seal the bottom of the plenum.

Inlet passageways or ports are located about the plenum for vacuumized airflow into the plenum for subsequent filtration. Filtration can be any porous filter and centrifugal system or the like. One such passageway, a lower inlet port, is located on and extends from the bottom of the plenum and connects to a gutter broom air conduit which communicates with a gutter cleaning head including a cleaning head shroud forming a cleaning head chamber capable of being vacuumized and being located beneath the sweeper truck chassis for vacuumized removal of airborne dust. Additionally, appropriately sized upper inlet ports located on the upper and rear side of the plenum communicate to the interior of the hopper and to a connected conveyor housing or conduit and thence to an elongated cleaning head including an elongated cleaning head shroud forming an elongated cleaning head chamber which can be vacuumized which is located about the main rotary broom for vacuumized removal of airborne dust.

Vacuum integrity of the plenum is automatically maintained during sweeping operations by the plurality of automatic flexible airflow operated flap valves which are influenced by vacuum (airflow) and urged to the closed position. Subsequent to the sweeping operation and when cleaning of the filter mechanism is required, power to the fan is stopped, thereby influencing the vacuum integrity of the plenum causing the cessation of vacuum in the plenum and the areas or regions with which the vacuum communicates. The filter shaker mechanism is then actuated at this time to expel dust and small debris from the filter mechanism which descends gravitationally to the region in the plenum just below the filter to pass through the flap valves which have been gravitationally opened due to the cessation of vacuum or airflow within the plenum. The dust and debris passes through the open flap valves into the lower regions of the hopper. The filter shaker mechanism includes an elongated cam which repeatedly causes gradual vertical upward movement of a rod encased in each of the lower folds of each filter to momentarily deform each filter fold followed by sudden cam disengagement to cause rapid downward movement of the rods, whereby the force of which causes vigorous snapping retensioning of the folds to expel dust particles therefrom.

According to one or more embodiments of the present invention, there is provided a street sweeper having dust control from two or more cleaning heads with one air source including a hopper, a plenum mounted in the upper region of the hopper, a fan mounted to the top of the plenum, a filter mechanism located at the upper region of the plenum in close proximity to and below the fan including fixed rods extending across the top of the plenum being captured by and extending through the upper region filter folds and positionable rods extending across the lower region of the plenum being captured by and extending through the lower region filter folds, cutouts in the lower region of the filter folds which expose a portion of each of the positionable rods, a filter shaker mechanism having a motorized cam extending perpendicularly to the positionable rods for contacting the exposed portion of each of the positionable rods, a plenum bottom having a plurality of orifices in an array, a plurality a flexible valves which align to the bottom of the plurality of arrayed orifices, a duct extending downwardly from a lower inlet port at the plenum bottom and connecting to a gutter cleaning head surrounding opposing gutter broom assemblies, and inlet ports in the upper and rear portion of the plenum. Other shown items which relate to the use of the present invention include a conveyor mechanism contained in a conveyor housing or conduit extending between the upper region of the hopper and a vacuumized chamber at the rear of a road sweeper truck, and a truck-mounted scissors jack which supports the hopper and contained plenum.

One significant aspect and feature of the present invention is a street sweeper having dust control from two or more cleaning heads with one air source.

Another significant aspect and feature of the present invention is a filter shaker mechanism which cleans a filter in a filter mechanism without removal of the filter from the sweeper truck.

Still another significant aspect and feature of the present invention is a plurality of fixed rods located in the upper region of the filter folds and a plurality of partially exposed positionable rods located and captured in the lower region of the filter folds.

Yet another significant aspect and feature of the present invention is a filter shaker mechanism having a cam which urges a plurality of partially exposed positionable rods captured in the lower region of the filter folds upwardly to cause upward distortion, displacement and distension of the filter folds followed by a sudden disengagement from intimate cam contact thereby allowing the filter folds to snappingly and jarringly return to the unactuated position to release and shed dust particles from the surfaces of the filter folds. Such action is repeated until cleaning is complete.

A further significant aspect and feature of the present invention is an array of automatic flexible airflow operated valves co-acting with arrayed orifices in a plenum bottom. When air is flowing, each valve is positioned by airflow against the plenum bottom to seal the bottom of the plenum. When air is not flowing, each valve relaxes and gravitationally repositions from intimate contact with the plenum bottom to break the seal with the bottom of the plenum.

Having thus described embodiments of the present invention and mentioned some significant aspects and features thereof, it is the principal object of the present invention to provide a street sweeper having dust control from two or more cleaning heads with one air source, and which also provides for filter cleaning.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
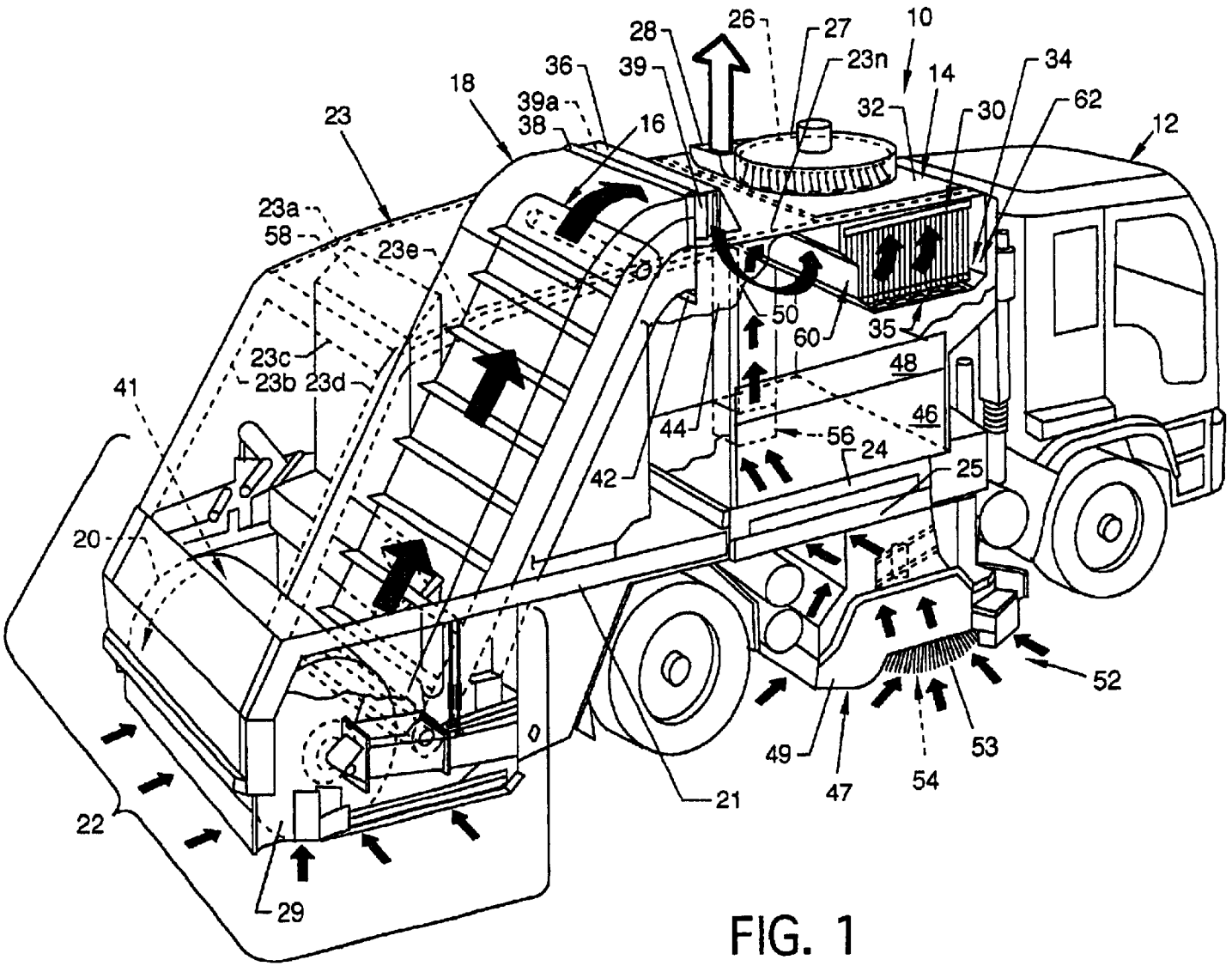
FIG. 1 illustrates a cutaway overview of the street sweeper having dust control from two or more cleaning heads with one air source, the present invention.

FIG. 1 illustrates a cutaway overview of the street sweeper 10, the present invention, having dust control from two or more cleaning heads with one air source. Major components and other components complementary to the street sweeper are mounted to and secured to the frame or chassis 13 (FIG. 2) of a truck 12 or are mounted elsewhere at other locations about the invention. Major components of the invention include a vacuum source, such as a fan 26, a fan shroud 27, a hopper 14, a plenum 34, an orificed plenum array 35, a plurality of one-piece flap valves 37*a*–37*n* (FIG. 3), a filter mechanism 30 including a filter 33 and other components which provides for support and function thereof, and a filter shaker mechanism 31 (FIG. 2), the majority of which connect associatively with other major members and components of the street sweeper 10 including a gutter broom assembly 52 having a right gutter broom 53 and a left gutter broom (not shown), a gutter cleaning head 47 including a cleaning head shroud 49 forming a gutter cleaning head chamber 54 which is capable of being vacuumized, a vertically oriented gutter broom duct or air conduit 56 between the gutter cleaning head chamber 54 and the hopper 14, a conveyor mechanism 16, a conveyor housing or conduit 18, a rotary broom 20, an elongated cleaning head 22 including an elongated cleaning head shroud 29 and elongated cleaning head chamber 41 which is capable of being vacuumized and which communicates with the hopper 14, the members of which are arranged and mounted to the chassis 13 of the truck 12 or other frameworks. The rearwardly extending framework 21 and an opposing like framework (not shown) mount and secure to the chassis 13 of the truck 12 to accommodate a portion of the components of the invention or associated components. A superstructure framework 23 including a plurality of framework members 23*a*–23*n* is shown partially and generally in dashed lines extending upwardly and forwardly from the framework 21 to serve as structure for mounting of fixed panels or access panels, doors or other devices as required. An optional water tank 58 is installed for wet sweeping, if required.

Figure 2:
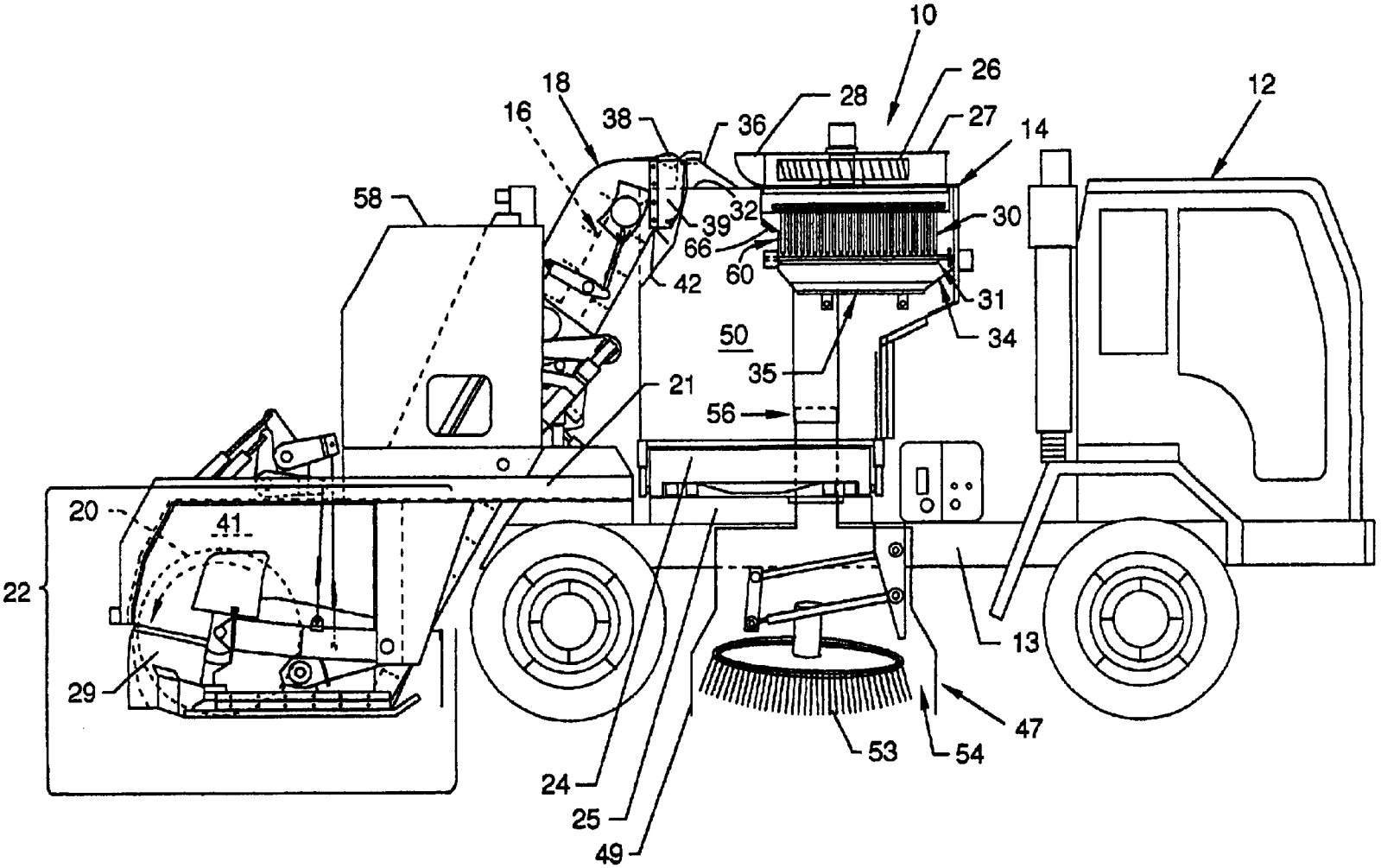
FIG. 2 illustrates a cutaway side view of the street sweeper.

The hopper 14 secures to the truck chassis 13 via a scissors jack assembly 24 which mounts to the truck chassis 13 via a scissors jack mounting frame 25. The plenum 34 and associated plenum panels (see also FIG. 2) is located at the upper region of the hopper 14 and houses and supports the filter mechanism 30. The fan 26, a vacuum source, is attached to a hopper top panel 32 or, alternatively, may be mounted within the plenum 34, above the plenum 34, or external to the plenum 34 via an air conduit, and has an exhaust port 28 which is open to and which communicates through the filter mechanism 30 in part with the interior of the hopper 14, in part with the gutter cleaning head 47, and in part with the elongated cleaning head 22 at the rear of the street sweeper 10. The top of the filter mechanism 30 aligns closely to the bottom surface of the hopper top panel 32 in close proximity to the bottom of the fan 26. The orificed plenum array 35 orients to and faces the lower interior of the hopper 14. The one-piece flap valves 37*a*–37*n* (FIG. 3) in the orificed plenum array 35 close during sweeping operations and open during cleaning cycles as dictated by airflow. The fan 26 communicates via the filter mechanism 30 and the gutter broom duct or air conduit 56 to the gutter cleaning head 47. Inlet ports 66 and 68 (FIG. 3), which are screened and which are located in the upper and rear portion of the plenum 34, communicate with the interior of the hopper 14 and subsequently with the conveyor housing or conduit 18 and elongated cleaning head 22 at the rear of the street sweeper 10. A receiver duct 36 mounts to the hopper top panel 32 to communicate with the interior of the hopper 14 and to sealingly connect with the elevated end of conveyor housing or conduit 18. A flexible seal 38 and opposing flexible side seals 39 and 39*a* and other seals located at the upper end of the conveyor housing or conduit 18 seal against components located at the inlet of the receiver duct 36, as shown in FIG. 2. An angled channel 42 is located in a vertically oriented hopper rear panel 44 for accommodation of the upper end of the conveyor mechanism 16. Lower and upper access doors 46 and 48 for emptying of the hopper 14 are located on an outwardly facing and vertically oriented right hopper panel 50 of the hopper 14. The hopper 14 also includes a left hopper panel 51 and a configured front hopper panel 55, both shown in FIG. 5.

FIG. 2 illustrates a cutaway side view of the street sweeper 10. Illustrated in particular is the hopper 14, the fan 26, the plenum 34, the filter mechanism 30, the filter shaker mechanism 31, the orificed plenum array 35, the gutter broom duct or air conduit 56 and the gutter cleaning head 47 which connect associatively with other members and components of the street sweeper 10. Filtration components, such as, but not limited to, the filter mechanism 30, the filter shaker mechanism 31, and the orificed plenum array 35, may be positioned within the plenum 34, as shown, or may be positioned above the plenum 34, or external to the plenum 34 via an air conduit.

Figure 3:
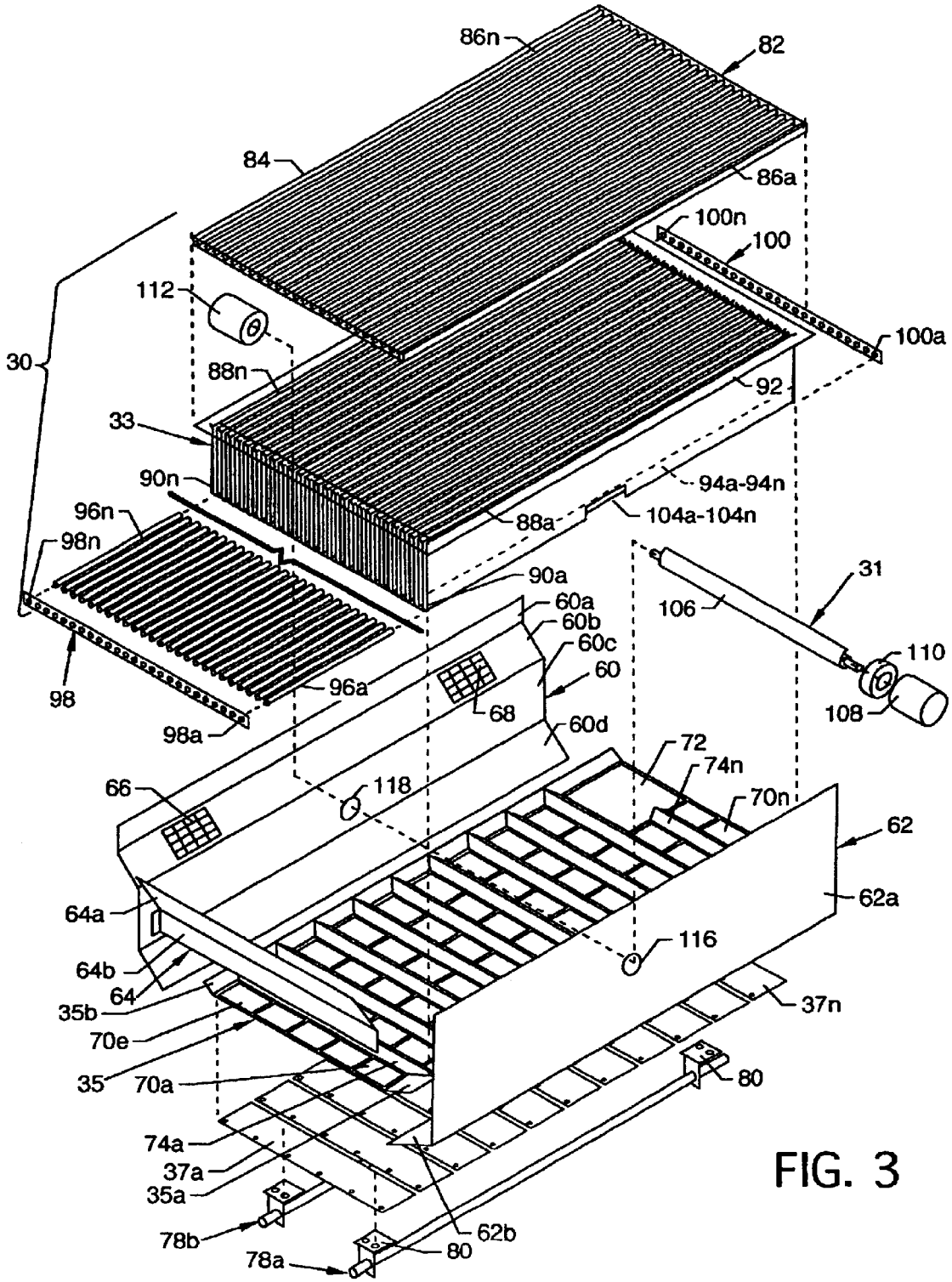
FIG. 3 illustrates an exploded view of the filter, certain components of the plenum, the filter shaker mechanism and other associated components which, in part, provide for dust control from two or more cleaning heads with one air source for the street sweeper.
Figure 4:
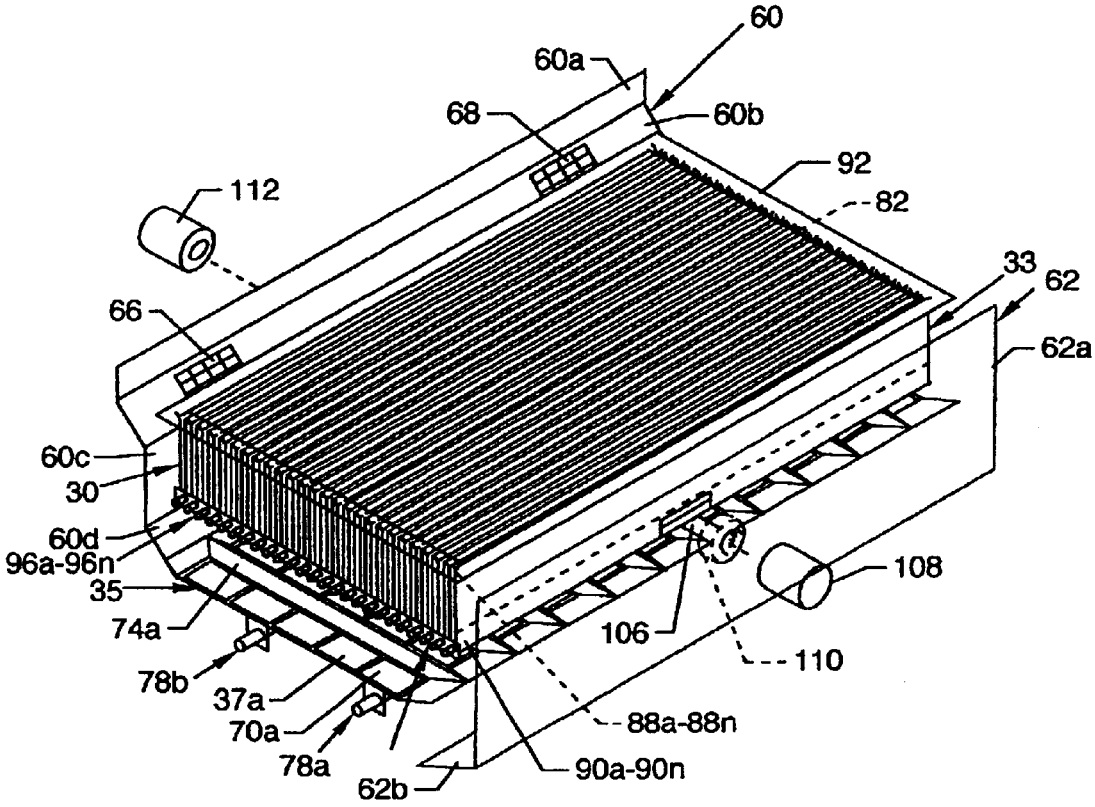
FIG. 4 illustrates an assembled view of the filter mechanism, certain components of the plenum, the filter shaker mechanism and other associated components which, in part, provide for dust control from two or more cleaning heads with one air source for the street sweeper.

FIG. 3 illustrates an exploded view, and FIG. 4 illustrates an assembled view of the filter mechanism 30, certain components of the plenum 34, the filter shaker mechanism 31, and other associated components which, in part, comprise the street sweeper 10, the present invention. The plenum 34 is formed in part by the illustrated components, as well as other components including portions of sidewalls of the hopper 14. The illustrated components of the plenum 34 include a multi-angled and configured rear plenum panel 60 having planar regions 60*a*, 60*b*, 60*c* and 60*d*, an angled and configured front plenum panel 62 having planar regions 62*a* and 62*b*, and an angled and configured right plenum panel 64 having planar regions 64*a* and 64*b*. Inlet ports 66 and 68 are located along and about the planar region 60*b* of the rear plenum panel 60.

The orificed plenum array 35 includes a plurality of valve orifices 70*a*–70*n* bordered by an angled front planar region 35*a* and an angled rear planar region 35*b*, as well as a lower inlet port 72 at one corner of the orificed plenum array 35. The angled front planar region 35*a* and the angled rear planar region 35*b* of the orificed plenum array 35 align to and extend between the angled planar region 62*b* of the front plenum panel 62 and the angled planar region 60*d* of the rear plenum panel 60, respectively. A plurality of inverted angle stock members 74*a*–74*n* align between the front planar region 35*a* and the rear planar region 35*b* of the orificed plenum array 35 to longitudinally separate the valve orifices 70*a*–70*n* and to offer support of the valve orifices 70*a*–70*n*. Each of the sides of the angle stock members 74*a*–74*n* presents a 45° angled surface with respect to the valve orifices 70*a*–70*n*. The 45° angle surfaces of the angle stock members 74*a*–74*n* serve to assist and channel dust and small debris through the valve orifices 70*a*–70*n* during the filter cleaning process, as later described in detail. A plurality of flap valves 37*a*–37*n* align to and secure to the underside of the orificed plenum array 35. The first flap valve 37*a* aligns to the first row of valve orifices 70*a*–70*n* containing valve orifices 70*a*–70*e* and each of the remaining flap valves 37*b*–37*n* aligns successively to the other rows of valve orifices 70*a*–70*n*. Identically constructed stop rods 78*a* and 78*b* secure to the underside of the orificed plenum array 35 by like brackets 80.

Filter 33 of the filter mechanism 30, the components of which are now described herein, suspends from a filter hanger 82 to align within the plenum 34. The filter hanger 82 is shown positioned above the filter 30 for purposes of illustration. The filter hanger 82 includes a four-sided frame 84 and a plurality of parallel rods 86*a*–86*n* mounted within the frame 84. The filter 33 is fashioned in a continuous manner wave-like configuration having a plurality of top folds 88*a*–88*n* and a plurality of bottom folds 90*a*–90*n* extending transversely. A flexible perimeter flap 92 is attached to the left and right edges of the top folds 88*a*–88*n*, as well as transversely to the top of the top folds 88*a* and 88*n*. During assembly, the filter 30 is lowered through and suspended by the filter hanger 82. During lowering the bottom folds 90*a*–9on are fitted between the parallel rods 86*a*–86*n* of the filter hanger 82 and then further lowered until the top folds 88*a*–88*n* engage the rods 86*a*–86*n* in the position shown in FIG. 4. The perimeter flap 92 is then folded over and about the surrounding frame 84 and secured thereto. Pockets 94*a*–94*n* at the bottom of each bottom fold 90*a*–90*n* are formed by stitching to capturingly accommodate a plurality of rods 96*a*–96*n* shown in foreshortened manner. The rods 96*a*–96*n* extend beyond the length of the pockets 94*a*–94*n* at both ends. A right rod keeper plate 98 having a plurality of holes 98*a*–98*n* aligns over the right end of the rods 96*a*–96*n*. A left rod keeper plate 100 having a plurality of holes 100*a*–100*n* aligns over the left end of the rods 96*a*–96*n*. Suitable devices such as cotter pins extending through the opposing ends of the rods 96*a*–96*n* ensure alignment and placement of the rods 96*a*–96*n* in the holes 98*a*–98*n* and 100*a*–100*n*, as well as ensure containment in the pockets 94*a*–94*n*. A plurality of cutouts 104*a*–104*n* are included at the bottom of each bottom fold 90*a*–90*n* to expose the rods 96*a*–96*n*.

A filter shaker mechanism 31 includes an eccentric cam 106, a motor 108, preferably hydraulic, and bearings 110 and 112. The bearing 110 supports one end of the eccentric cam 106 and the bearing 112 supports the other end of the eccentric cam 106. Motor 108 provides for rapid rotation of the eccentric cam 106 about its longitudinal axis. The eccentric cam 106 extends through holes 116 and 118 in the front plenum panel 62 and the rear plenum panel 60, respectively, and aligns in near proximity to the rods 96*a*–96*n* which are exposed through the cutouts 104*a*–104*n* in the bottom folds 90*a*–90*n* of the filter 33.

Figure 5:
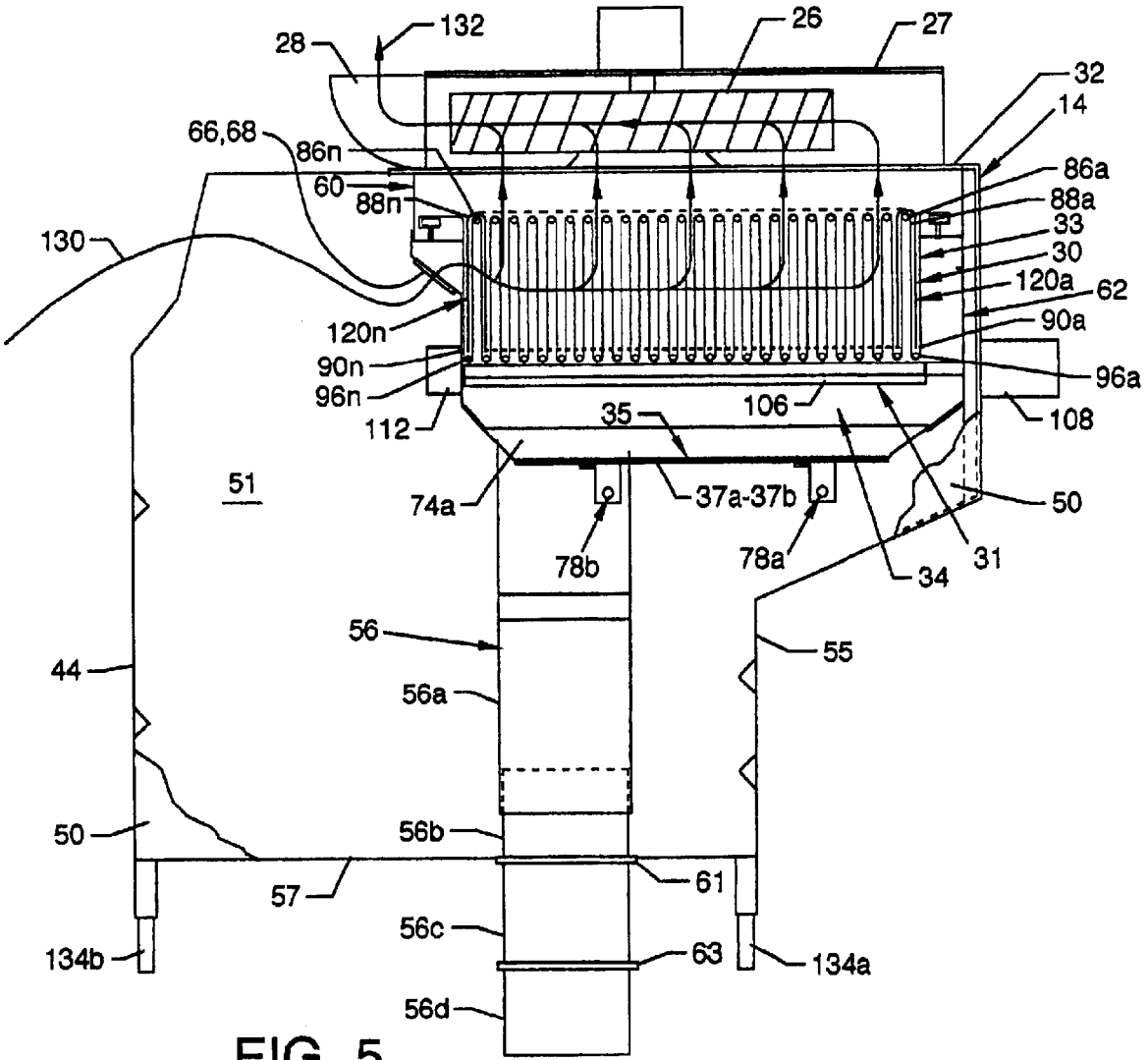
FIG. 5 illustrates a cutaway view of the hopper, the filter mechanism, and the plenum along with other components associated with those parts, and also illustrates the multi-component gutter broom duct.

FIG. 5 illustrates a cutaway view of the hopper 14, the filter mechanism 30, and the plenum 34 along with other components associated with these parts. Also illustrated is the multi-component gutter broom duct or air conduit 56 which includes a main section 56*a*, a top subsection 56*b* permanently telescoped into the main section 56*a*, a seal 61 secured to the bottom 57 of the hopper 14 in alignment to the telescoped top subsection 56*b*, a mid subsection 56*c* the top portion of which aligns to the bottom portion of the telescoped top subsection 56*b* and to the seal 61, a seal 63 aligned to the bottom of the mid subsection 56*c*, and a bottom subsection 56*d* the top part of which mates to the seal 63 and the bottom part of which secures to the gutter cleaning head chamber 54 (FIG. 1). Tipping of the hopper 14 for unloading can utilize various sections of the gutter broom duct or air conduit 56, as later described in relation to FIGS. 8 and 9, dependent on whether the hopper 14 is tipped at a low elevation or if the hopper 14 is raised by the scissors jack assembly 24 for tipping at an elevated position. The structure of the plenum 34 includes and is bounded in full or in part by the following major components including the rear plenum panel 60, the front plenum panel 62, a portion of the right hopper panel 50, the right plenum panel 64 (FIG. 3), a portion of the left hopper panel 51, the orificed plenum array 35 and attached flap valves 37*a*–37*n*, and, the hopper top panel 32. Also shown is the close proximity and orientation of the eccentric cam 106 with the plurality of rods 96*a*–96*n* in the bottom folds 90*a*–90*n* of the filter 33. It is to be noted that flexible U-shaped porous and breathable spacers 120*a*–120*n* (120*a* and 120*n* shown) are inserted over every other top fold 88*a*–88*n* of the filtered 33 and seated between the folds to provide adequate spacing between the vertical portions of adjacent folds and to maintain suitable filter shape.

Figure 6:
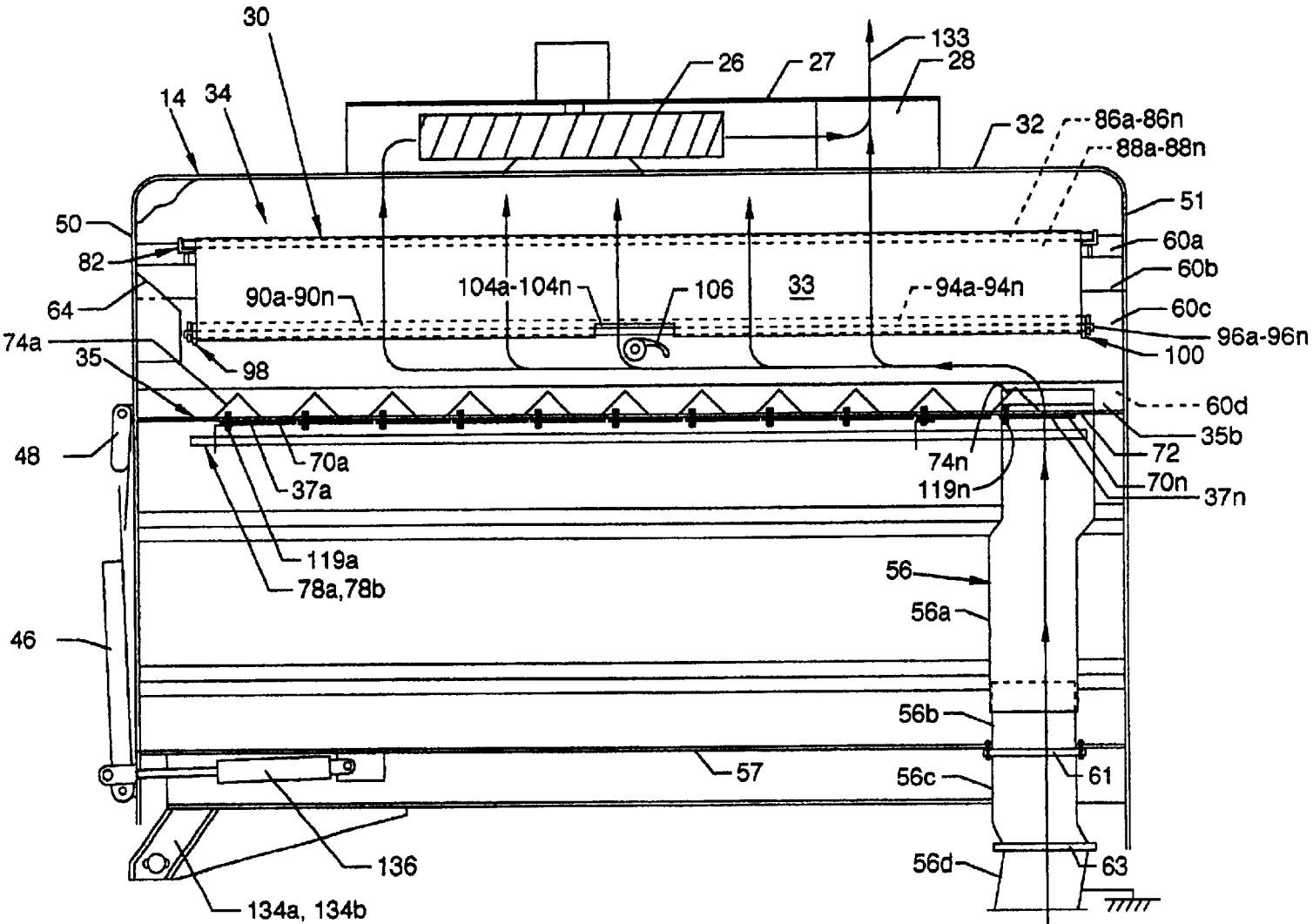
FIG. 6 illustrates a cutaway front view of the hopper revealing the filter mechanism, the plenum, and other components associated and utilized therewith during the sweeping mode.

FIG. 6 illustrates a cutaway front view of the hopper 14 revealing the filter mechanism 30, the plenum 34, and other components associated and utilized therewith during the sweeping mode. Illustrated in particular is the relationship of the flap valves 37*a*–37*n* to the respective valve orifices 70*a*–70*n*. A plurality of fasteners 119*a*–119*n* secure the flap valves 37*a*–37*n* to the respective valve orifices 70*a*–70*n*. Suction from the fan 26 creates a low pressure region in the upper region of the plenum 34 thereby causing the flap valves 37*a*–37*n* to be urged toward and against the valve orifices 70*a*–70*n*, thereby sealing the bottom of the plenum 34 at the orificed plenum array 35 to maintain vacuum integrity of the plenum 34 during sweeping. Also shown is the eccentric cam 106 in the un-actuated position in close proximity to the exposed portions of the rods 96*a*–96*n* in cutouts 104*a*–104*n* whereby the region between the top folds 88*a*–88*n* and bottom folds 90*a*–90*n* of the filter 33 are unaffected and fully extended in a downward direction owing directly to the weight of the rods 96*a*–96*n*.

The hopper 14 and associated plenum and filter components are capable of being tipped to discharge trash, debris and dust accumulated in the sweeping process. Pivot supports 134*a* and 134*b* attached to the lower regions of the hopper 14 allow for such tipping such as by components contained in the scissors jack assembly 24 (not shown). The pivotable lower access door 46, controlled by an actuating cylinder 136, is held retracted by the retracted actuating cylinder 136 which is shown in the retracted position. The retracted lower access door 46 engages the pivotable upper access door 48 to maintain the upper access door 48 in a closed position. During tipping, the actuating cylinder 136 is extended to open the lower access door 46 which then ceases to engage the upper access door 48, thereby allowing full opening of one side of the hopper 14 for emptying.

Figure 7:
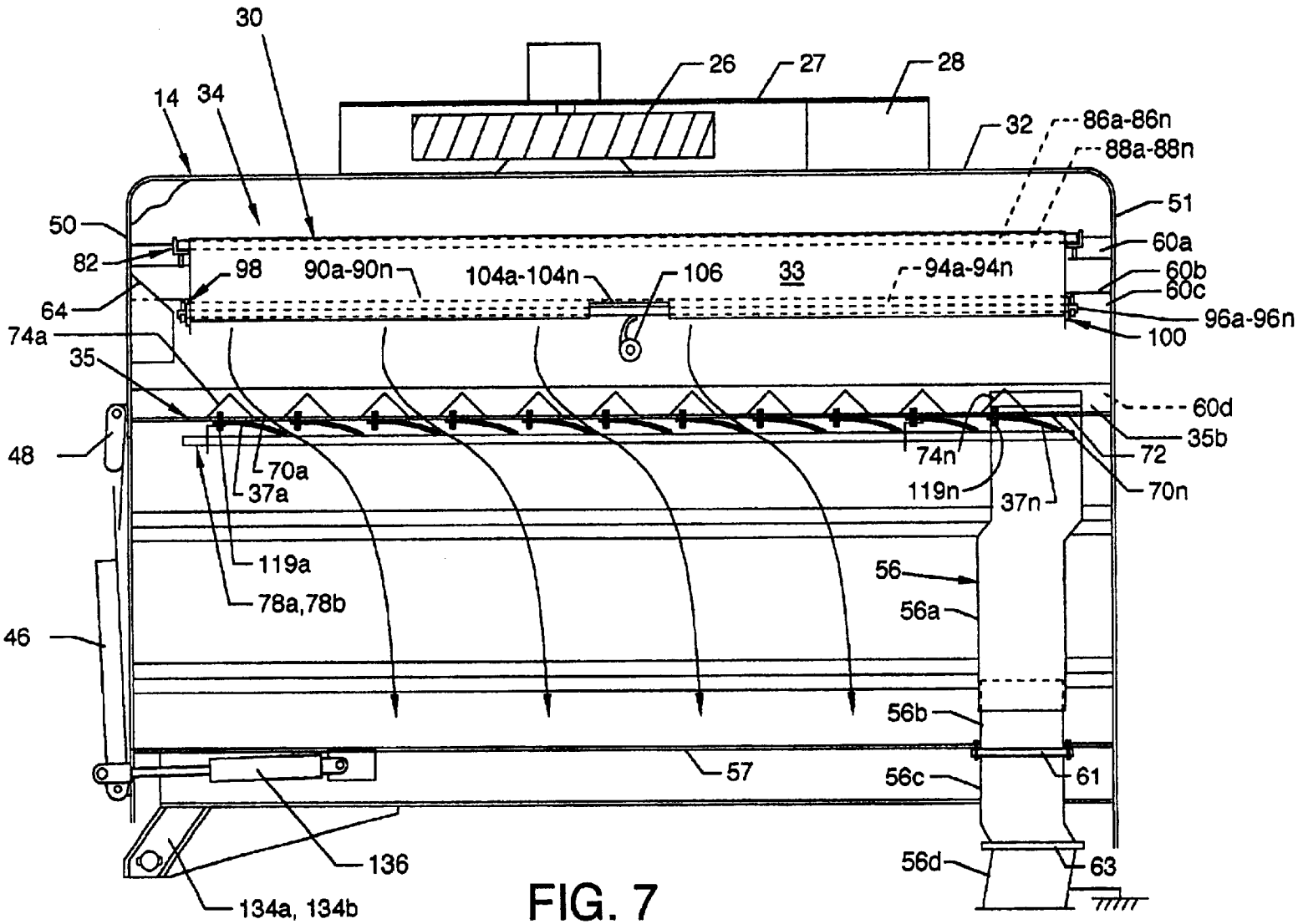
FIG. 7 illustrates a cutaway front view of the hopper revealing the filter mechanism, the plenum, and other components associated and utilized therewith during the filter mechanism cleaning mode during which the eccentric cam of the filter shaker mechanism is actuated.

FIG. 7 illustrates a cutaway front view of the hopper 14 revealing the filter mechanism 30, the plenum 34, and other components associated and utilized therewith during the filter cleaning mode during which the eccentric cam 106 of the filter shaker mechanism 31 is actuated. Illustrated in particular is the relationship of the flap valves 37*a*–37*n* to the respective valve orifices 70*a*–70*n*. Suction from the fan 26 is discontinued thereby creating regions of equal pressure region in the plenum 34 and in the lower region of the hopper 14, thereby causing relaxation of the flap valves 37*a*–37*n* to be gravitationally urged from intimate contact with the valve orifices 70*a*–70*n*, thereby opening the bottom of the plenum 34 at the orificed plenum array 35 to allow communication through the valve orifices 70*a*–70*n*. Also shown is the eccentric cam 106 in the actuated position in vigorous repeated contact with the exposed portions of the rods 96*a*–96*n* in cutouts 104*a*–104*n* whereby the folds of the filter 33 are agitated to release dust and other small debris particles.

Figure 8:
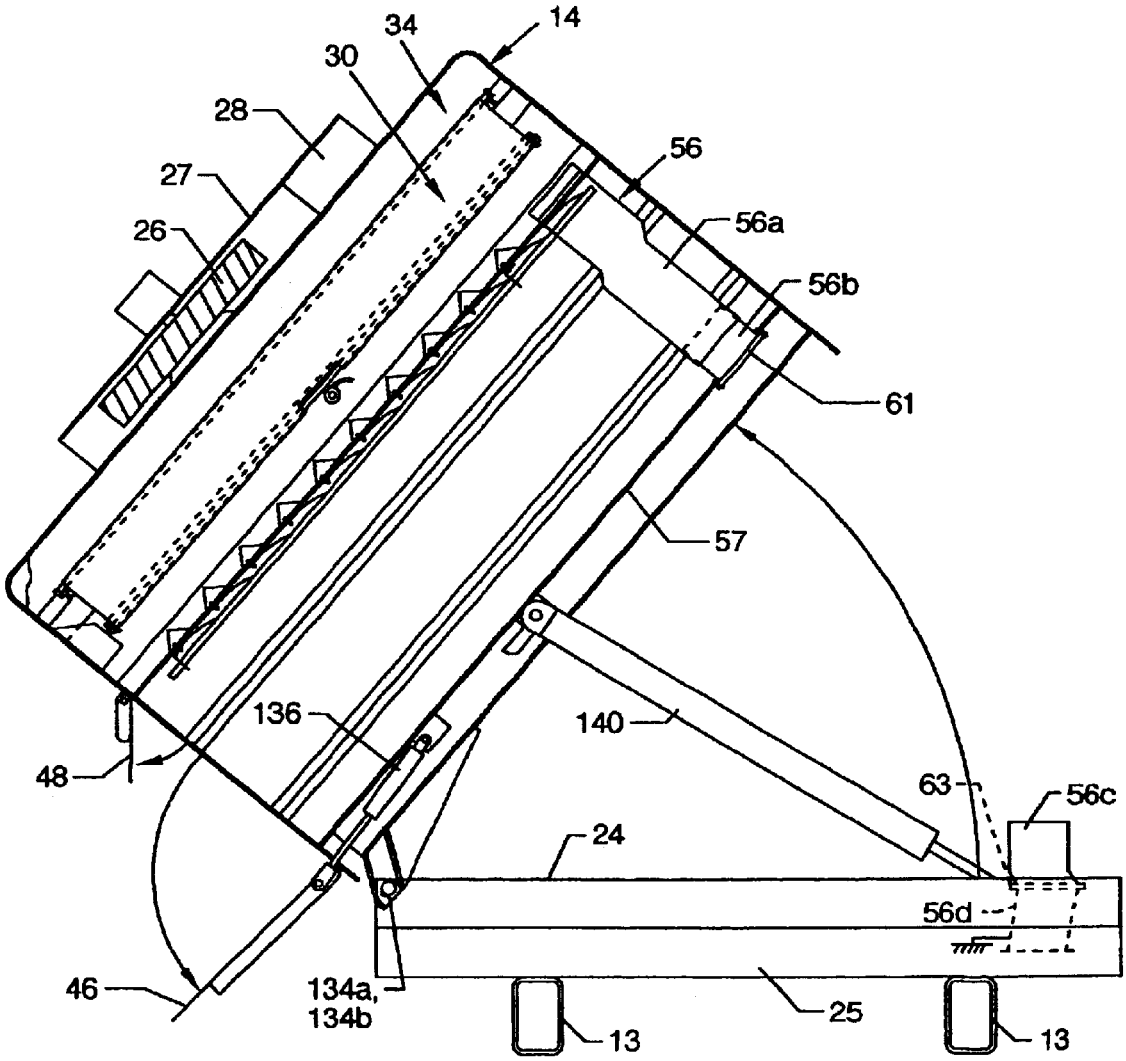
FIG. 8 illustrates a view of the hopper and associated components for the street sweeper in the tipping position at the level of a truck chassis.

FIG. 8 illustrates a view of the hopper 14 and associated components of the street sweeper 10 in the tipping position at the level of the truck chassis 13 where dirt and debris is emptied from the hopper 14 though the access doors 46 and 48. Tipping the hopper 14 can be accomplished at a non-elevated hopper level, such as at the level of the truck chassis 13, or a scissors jack 138 (FIG. 9) can be actuated and the hopper 14 can be tipped at levels above that of the truck chassis 13. In either case, an actuating cylinder 140 is actuated to effect hopper 14 tipping, as well as actuating cylinder 136, which allows opening of the lower and upper access doors 46 and 48, as previously described. During tipping of the hopper 14 at truck chassis 13 level, the main section 56*a* and the telescoped top subsection 56*b* separate from engagement with the upper portion of the mid subsection 56*c*.

Figure 9:
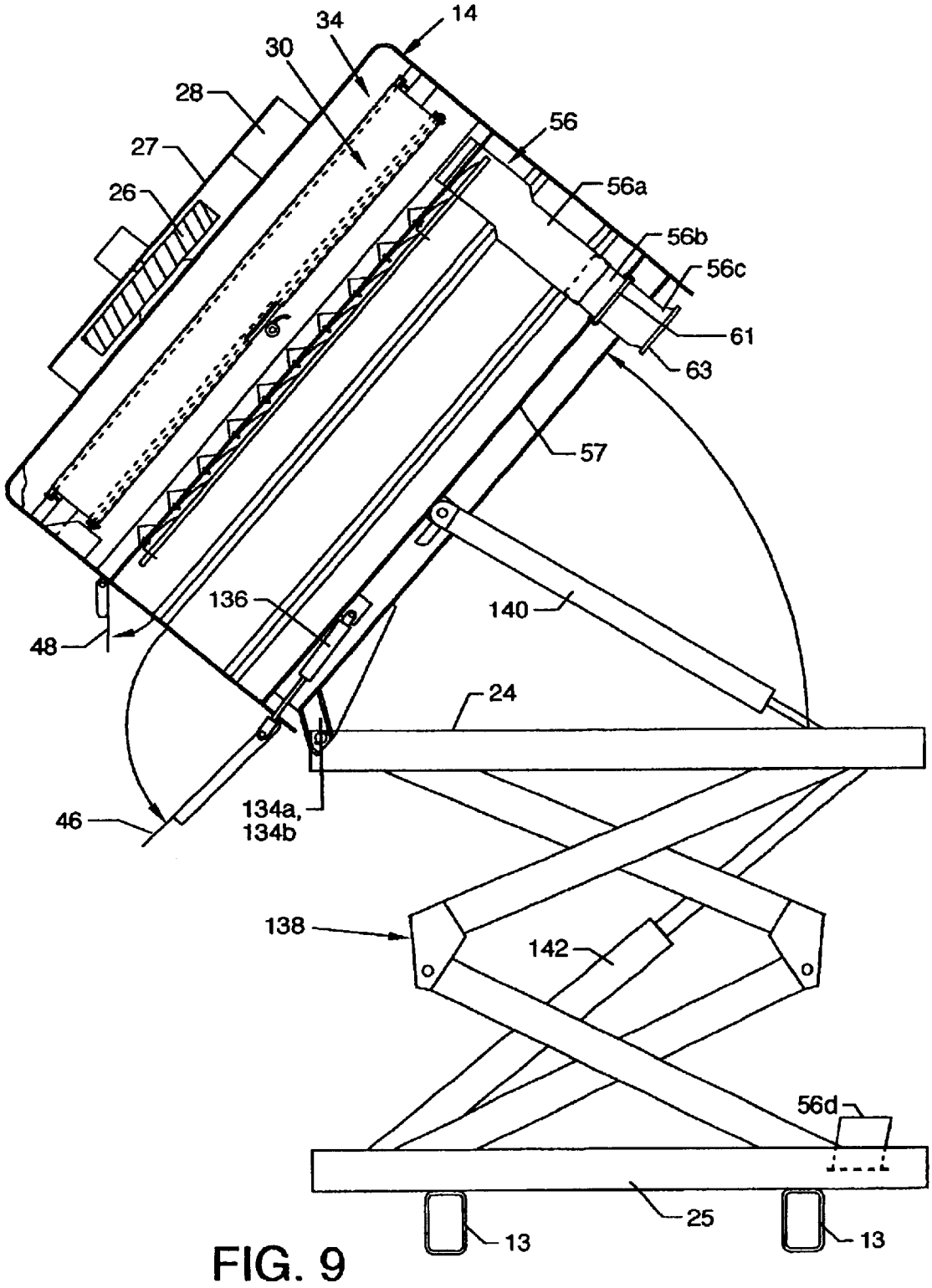
FIG. 9 illustrates a view of the hopper and associated components for the street sweeper in the tipping position above the level of a truck chassis; and, FIG. 10 is a simplified schematic of airflow through the components providing dust control from two or more cleaning heads for the street sweeper.

FIG. 9 illustrates a view of the hopper 14 and associated components of the street sweeper 10 in the tipping position above the level of the truck chassis 13 where dirt and debris is emptied from the hopper 14 through access doors 46 and 48 at a position elevated by the scissors jack 138 and by one or more actuating cylinders 142 to a level above the truck chassis 13. During tipping of the hopper 14 above the truck chassis 13 level, the main section 56*a*, the telescoped top subsection 56*b*, and the mid subsection 56*c* separate from engagement with the upper portion of the bottom subsection 56*d*. Alignment of gutter broom duct components 56*a*–56*d*, as previously described, accommodates geometrical conflicts with various support structures.

Figure 10:
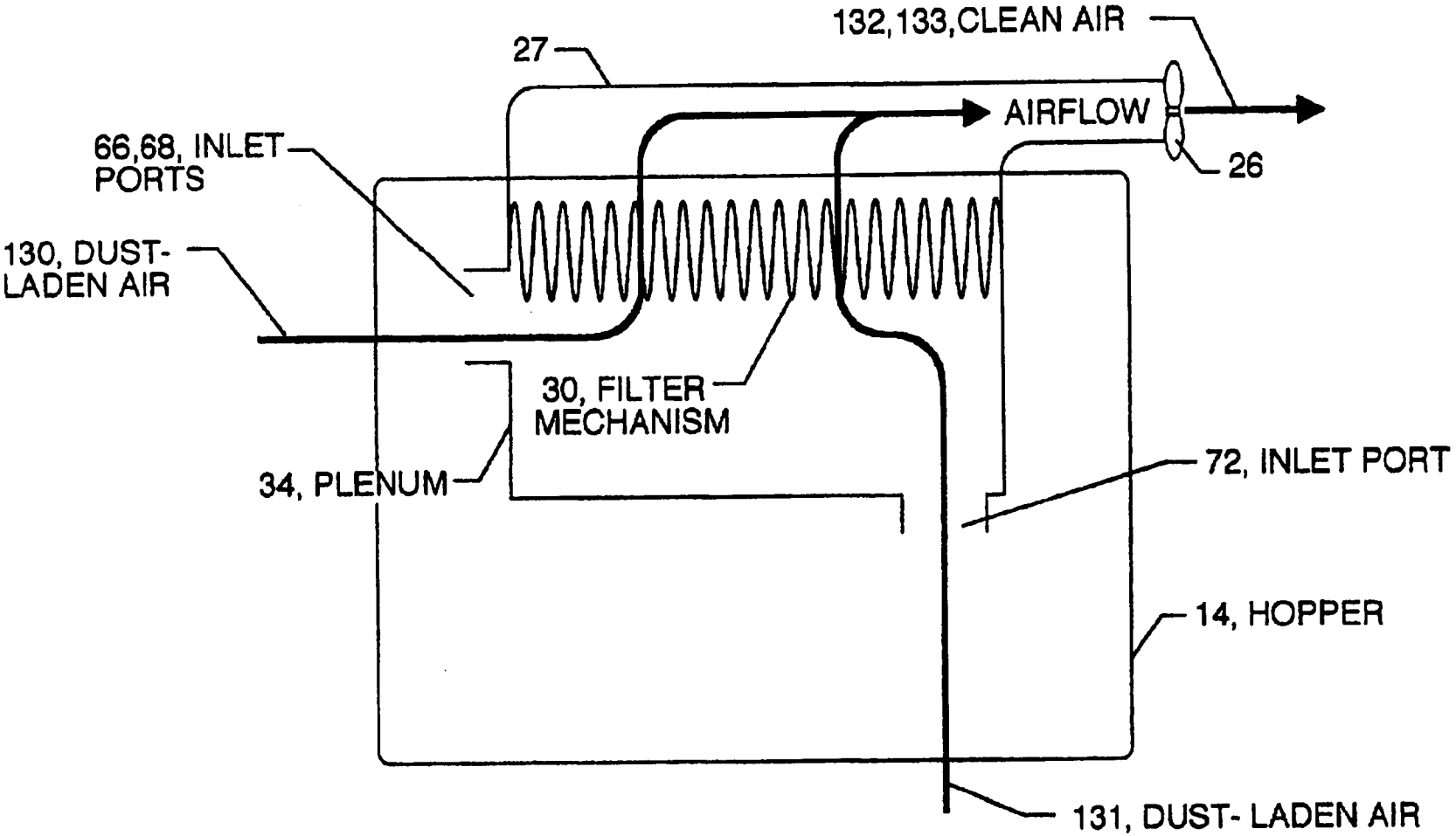

FIG. 10 is a simplified schematic of airflow through the central region of the street sweeper 10, where all numerals correspond to those elements previously described. Shown in particular is the flow of dust-laden air 130 through the inlet ports 66 and 68 into the plenum 34 and the flow of dust-laden air 131 through the lower inlet port 72 where the flows are combined and drawn through the filter mechanism 30 and through the fan 26 to exit as a combined flow of clean air 132 and 133. The proper and balanced volume or intensity of airflow through the elongated cleaning head 22 and through the gutter cleaning head chamber 54 (FIG. 1) is influenced largely by the sizes of the inlet ports 66 and 68 in relation to the size of the lower inlet port 72. For purposes of illustration and example, half of the flow could transit through the inlet ports 66 and 68 and the other half could flow through the lower inlet port 72. If increased vacuum is desired through the inlet ports 66 and 68 because of vacuum demands at the elongated cleaning head 22, the size of the lower inlet port 72, the opposing orifice, could be adjusted downwardly to decrease the flow through the lower inlet port 72 to allow an increase of flow through the inlet ports 66 and 68. Conversely, if increased vacuum is desired through the lower inlet port 72 because of vacuum demands at the gutter cleaning head chamber 54, the sizes of the inlet ports 66 and 68, the opposing orifices, could be adjusted downwardly to decrease the flow through the inlet ports 66 and 68 to allow an increase of flow through the lower inlet port 72.

Mode of Operation

FIGS. 5–10 illustrate the mode of operation of the street sweeper 10 with respect to sweeping and cleaning of dust-laden air 130. FIG. 5 illustrates the flow of dust-laden air 130 from the elongated cleaning head 22 via the conveyor housing or conduit 18 (FIG. 2). The fan 26 creates an area of low pressure within the plenum 34 wherein part of the flow created by the low pressure communicates through the inlet ports 66 and 68 to draw the dust-laden air 130 through the inlet ports 66 and 68. The balance of the flow draws dust-laden air 131 from the gutter cleaning head 47 via the gutter broom duct or air conduit 56 and the lower inlet port 72, as shown in FIG. 6. The dust-laden air 130 then is drawn through the filter 33 for filtration of dust and small debris. The fan 26 then expels the clean air 132 from the exhaust port 28 directly to atmosphere without recirculation. The low pressure created by the fan 26 also provides a pressure differential to ensure closure of the flap valves 37*a*–37*n* against the valve orifices 70*a*–70*n* during the sweeping mode to maintain integrity of the plenum 34. FIG. 6 illustrates the flow of dust-laden air 131 from the gutter cleaning head 47 (FIG. 2) via the gutter broom duct or air conduit 56 and the lower inlet port 72. The balance of the low pressure created by the fan 26 in the plenum 34 and not communicating through the inlet ports 66 and 68 communicates through the multi-membered gutter broom duct or air conduit 56 to draw the dust-laden air 131 through the gutter broom duct or air conduit 56 and thence through the bottom region of the plenum 34 through the lower inlet port 72 to be then drawn through the filter 33 and through fan 26 to be expelled directly as clean air 133 to the atmosphere. FIG. 7 illustrates the cleaning mode of operation for the street sweeper 10. Rotation of the fan 26 is stopped to accomplish the cleaning of the filter 33 of the filter mechanism 30 followed by application of suitable power to the motor 108 to cause rapid rotation of the eccentric cam 106. The rotating eccentric cam 106 contacts the portions of the rods 96*a*–96*n* exposed in the cutouts 104*a*–104*n* of the filter 33 to cause vigorous and repeated vertical or near vertical displacement of the rods 96*a*–96*n*. Vertical displacement of the rods 96*a*–96*n*, which are contained in the pockets 94*a*–94*n*, carries the bottom folds 90*a*–90*n* of the filter 33 upwardly in unison with rod 96*a*–96*n* displacement. Just after maximum vertical displacement of the rods 96*a*–96*n* and the bottom folds 90*a*–90*n*, the eccentric cam 106 rotatingly and suddenly disengages from intimate contact with and terminates immediate contactual influence with the rods 96*a*–96*n*, thereby allowing gravitational forces to cause the rods 96*a*–96*n*, being of sufficient weight, to descend forcefully and rapidly. Such forceful and rapid descent of the rods 96*a*–96*n* is brought to a rapid and jarring halt as the folds of the filter 33 suddenly retension, thereby causing a jolting and snapping action of the folds and walls of the filter 33. Repeated jolting and snapping action jars dust and small debris from the filter 33. During the filter cleaning mode, the flap valves 37*a*–37*n* are no longer held in position against the valve orifices 70*a*–70*n* of the orificed plenum array 35 due to the lack of differential pressure on the opposite sides thereof. The open valve orifices 70*a*–70*n* allow dust and small debris to pass therethrough for collection in the lower regions of the hopper 14. The downward travel of the unactuated flap valves 37*a*–37*n* is limited by the stop rods 78*a*–78*b* in order to keep the flap valves 37*a*–37*n* sufficiently close to the valve orifices 70*a*–70*n* to ensure vacuum operation of the flap valve 37*a*–37*n* to the closed position against the valve orifices 70*a*–70*n* upon reactivation of the fan 26 during sweeping. The hopper 14 can be tipped and emptied, as previously described in FIGS. 8 and 9.

Although a street sweeper is described, such operating principles and structures, as described herein, can be applied to sweepers of other sizes, such as a floor sweeper or other sweeping devices, and shall not be deemed to be limiting to the scope of the invention.

Various modifications can be made to the present invention without departing from the apparent scope hereof.

STREET SWEEPER

PARTS LIST

| | |
|---|---|
| 10 | street sweeper |
| 12 | truck |
| 13 | chassis |
| 14 | hopper |
| 16 | conveyor mechanism |
| 18 | conveyor housing or conduit |
| 20 | rotary broom |
| 21 | framework |
| 22 | elongated cleaning head |
| 23 | superstructure framework |
| 23a–n | superstructure framework members |
| 24 | scissors jack assembly |
| 25 | scissors jack mounting frame |
| 26 | fan |
| 27 | fan shroud |
| 28 | exhaust port |
| 29 | elongated cleaning head shroud |
| 30 | filter mechanism |
| 31 | filter shaker mechanism |
| 32 | hopper top panel |
| 33 | filter |
| 34 | plenum |
| 35 | orificed plenum array |
| 35a | front planar region |
| 35b | rear planar region |
| 36 | receiver duct |
| 37a–n | flap valves |
| 38 | flexible seal |
| 39 | flexible side seal |
| 39a | flexible side seal |
| 41 | elongated cleaning |
| 42 | angled channel |
| 44 | rear hopper panel |
| 46 | lower access door |
| 47 | gutter cleaning head |
| 48 | upper access door |
| 49 | (gutter) cleaning head shroud |
| 50 | right hopper panel |
| 51 | left hopper panel |
| 52 | gutter broom assembly |

-continued

STREET SWEEPER

PARTS LIST

| | |
|---|---|
| 53 | right gutter broom |
| 54 | gutter cleaning head chamber |
| 55 | front hopper panel |
| 56 | gutter broom duct or air conduit |
| 56a | main section |
| 56b | top subsection |
| 56c | mid subsection |
| 56d | bottom subsection |
| 57 | hopper bottom |
| 58 | water tank |
| 60 | rear plenum panel |
| 61 | seal |
| 60a–d | planar regions |
| 62 | front plenum panel |
| 63 | seal |
| 62a–b | planar regions |
| 64 | right plenum panel |
| 64a–b | planar regions |
| 66 | inlet port |
| 68 | inlet port |
| 70a–n | valve orifices |
| 72 | lower inlet port |
| 74a–n | angle stock members |
| 78a–b | stop rods |
| 80 | bracket |
| 82 | filter hanger |
| 84 | frame |
| 86a–n | rods |
| 88a–n | top folds |
| 90a–n | bottom folds |
| 92 | perimeter flap |
| 94a–n | pockets |
| 96a–n | rods |
| 98 | right rod keeper plate |
| 98a–n | holes |
| 100 | left rod keeper plate |
| 100a–n | holes |
| 104a–n | cutouts |
| 106 | eccentric cam |
| 108 | motor |
| 110 | bearing |
| 112 | bearing |
| 116 | hole |
| 118 | hole |
| 119a–n | fasteners |
| 120a–n | spacers |
| 130 | dust-laden air |
| 131 | dust-laden air |
| 132 | clean air |
| 133 | clean air |
| 134a–b | pivot supports |
| 136 | actuating cylinder |
| 138 | scissors jack |
| 140 | actuating cylinder |
| 142 | actuating cylinder(s) |

What is claimed is:

1. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. at least a first gutter cleaning head in fluid communication with the vacuum source, and having an opening adjacent a gutter area intended to be cleaned;

d. a hopper for collecting dust, dirt, and debris;

e. a conveying mechanism in fluid communication with the vacuum source, and thereby vacuumed, and in communication with the road surface cleaning head for transporting dust, dirt, and debris from the main road surface cleaning head to the hopper; and, f. a common air filtration mechanism for substantially removing airborne dust in air drawn from the main cleaning head opening and the gutter cleaning head opening by way of the vacuum source, g. the main road surface cleaning head includes an elongated rotary broom having a rotational axis substantially aligned with the surface;

h. the gutter cleaning head includes a rotary broom having an axis of rotation generally transverse to the road surface; and, i. said conveying mechanism is a conveyor mechanism for transporting the dirt and debris to the hopper, and where the conveyor mechanism is surrounded at least in part by a vacuumized housing having an open end in communication with the main road surface cleaning head, and a second open end in communication with the hopper.

2. The road sweeper of claim 1, wherein:

a. the main road surface cleaning head includes a pressurized air inlet and an air outlet whereby debris entrained with and carried along by the air being conducted through the main road surface cleaning head exits therefrom through the conveying mechanism; and b. the conveying mechanism is an air conduit for transporting any dirt and debris to the hopper.

3. The road sweeper of claim 1, further including an air intake plenum having, a. one or more first inlet ports in communication with an air chamber formed by the hopper;

b. at least one second inlet port in direct communication with the gutter cleaning head through an air conduit coupled thereto; and c. a plenum air exit port in communication with the vacuum source.

4. The road sweeper of claim 3, wherein:

a. the air intake filtration mechanism is mounted within, at least in part, the air plenum and includes a mechanism for loosening any dirt therewith to fall with gravity; and b. the air intake plenum includes an adjustable bottom portion open to the hopper in a first configuration, and substantially closed relative to the hopper in a second configuration, so that any loosened dirt may fall into the hopper when the adjustable bottom portion is in the first configuration.

5. The road sweeper of claim 4, wherein the adjustable bottom portion includes flap valves operable in a first condition for sealing the bottom portion of the air plenum relative to the hopper, and in a second condition for opening the bottom portion open to the hopper.

6. The road sweeper of claim 5, wherein the flap valves are automatically operated by the presence or absence of airflow established by the vacuum source.

7. The road sweeper of claim 4, wherein the filtration mechanism includes:

a. a porous filter for passing air therethrough and depositing any airborne dust therewith on the filter; and b. a filter mechanism for shaking the collected dust on the porous filter to fall with gravity.

8. The road sweeper of claim 7, wherein said filter mechanism includes a cam.

9. The road sweeper of claim 8, wherein the cam lifts a rod in contact with said filter.

10. The road sweeper of claim 9, wherein the rod lifted by the cam is one of a plurality of positionable rods located at lower folds of said filter.

11. The road sweeper of claim 4, wherein the filtration mechanism includes a centrifugal dust collection system for passing air therethrough and collecting any airborne dust therewith.

12. The road sweeper of claim 7, wherein said filter is held within the plenum by a plurality of fixed rods extending across a top region of the main plenum during operation of the filter mechanism.

13. A street sweeper, comprising:

a. a framework for mounting to a truck chassis;

b. a vacuum source carried by the framework, the vacuum source including a main plenum having a top and bottom, a hopper depending from the plenum, a filter mechanism, and an adjustable plenum being sealable in a first configuration and open in a second configuration;

c. a first elongated cleaning head in fluid communication with the vacuum source, the first elongated cleaning head opening adjacent a roadway surface to be swept and about a main rotary broom for vacuumized removal of airborne dust, and having a connected conveyor housing providing fluid communication between the first elongated cleaning head and the vacuum source; and, d. a second cleaning head in fluid communication with the vacuum source, the second cleaning head opening adjacent a roadway gutter to be cleaned and about a gutter broom located beneath the truck chassis for vacuumized removal of airborne dust, and having a connected duct providing fluid communication between the second cleaning head and the vacuum source.

14. Street sweeper of claim 13, wherein the vacuum source is non-operational during operation of the filter mechanism.

15. A street sweeper, comprising:

a. a plenum, the plenum being mountable on a truck-mounted dry street sweeper, the plenum having a top, at least one side and a bottom;

b. a fan mounted atop the plenum, the fan arranged to generate an upward airflow, including airborne dust, within the plenum and toward the fan by creation of low pressure in the plenum;

c. a filter mounted beneath the fan, the filter situated to intercept airborne dust in the plenum; and, d. a hopper located beneath the plenum and separated from the plenum by at least one valve, the valve being closed, in a first configuration, and being open to allow dust to fall from the plenum to a lower hopper, in a second configuration, e. wherein the valve is automatically closed by the occurrence of decreasing pressure in the plenum.

16. The street sweeper of claim 15, wherein the valve is automatically opened by gravity action and lack of occurrence of decreasing pressure in the plenum.

17. A street sweeper, comprising:

a. a framework for mounting to a truck chassis;

b. a vacuum source carried by the framework;

c. a plenum with an adjustable bottom sealing the bottom of said plenum in a first configuration and opening the bottom of the plenum in a second configuration;

d. a hopper depending from said plenum;

e. a filter and filter shaker mechanism mounted in said plenum and an orificed plenum array with automatic flexible airflow operated valves;

f. a first elongated cleaning head in fluid communication with said vacuum said first elongated cleaning head opening adjacent a roadway surface to be swept and about a main rotary broom for vacuumized removal of airborne dust; and, g. a connected conveyor housing providing fluid communication between said first elongated cleaning head and the vacuum means.

18. Street sweeper of claim 17, including wherein the automatic flexible airflow operated flap valves of the orificed plenum array open at the bottom of the plenum, in the second configuration, when the vacuum source is non-operational.

19. Street sweeper of claim 17, including wherein the automatic flexible airflow operated flap valves of the orificed plenum array which sea; at the bottom of the plenum, in the first configuration, when the vacuum source is operational.

20. A street sweeper, comprising:

a. a framework for mounting to a truck chassis;

b. a vacuum source carried by the framework;

c. a plenum having an adjustable bottom sealing the bottom of the plenum in a first configuration and opening the bottom of the plenum in a second configuration;

d. a hopper depending from the plenum;

e. a filter and filter shaker mechanism mounted in the plenum and below the vacuum source;

f. a first elongated cleaning head in fluid communication with the vacuum source, the first elongated cleaning head opening adjacent a roadway surface to be swept and about a main rotary broom for vacuumized removal of airborne dust;

g. a connected conveyor conduit providing fluid communication between the first elongated cleaning head and the vacuum source; and, h. at least one second cleaning head in fluid communication with the vacuum source, the at least one second cleaning head opening adjacent a roadway gutter to be cleaned and about a gutter broom located beneath the truck chassis for vacuumized removal of airborne dust, and having a connected duct providing fluid communication between the second cleaning head and the vacuum source.

21. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. a hopper for collecting dust, dirt, and debris;

d a mechanical conveying mechanism in fluid communication with the vacuum source, and thereby maintaining a flow of vacuumazed air along at least a portion of the mechanism, and in communication with the surface cleaning head for transporting dust, dirt, and debris from the main road surface cleaning head to the hopper; and, e. a common air filtration mechanism for substantially removing airborne dust in air drawn from the main cleaning head opening and the gutter cleaning head opening by way of the vacuum source;

f. the main road surface cleaning head includes an elongated rotary broom having a rotational axis substantially aligned with the surface;

g. said conveying mechanism is a conveyor mechanism for transporting the dirt and debris to the hopper, and where the conveyor mechanism is surrounded at least in port by a vacuumized housing having an open end in communication with the main road surface cleaning head, and a second open end In communication with the hopper.

22. The road sweeper of claim 21, wherein:

a. the main road surface cleaning head includes a pressurized air inlet and an air outlet whereby debrIs entrained with and carried along by the air being conducted through the main road surface cleaning head exits therefrom through the conveying mechanism; and b. the conveying mechanism includes an air conduit for transporting any dirt and debris to the hopper.

23. A street sweeper, comprising:

a. a framework for mounting to a truck chassis;

b. a vacuum source carried by the framework, the vacuum source including a main plenum having a top and bottom, a hopper depending from the plenum, a filter mechanism, and an adjustable plenum being sealable in a first configuration and open in a second configuration; and c. a first clongated cleaning head in fluid communication with the vacuum source, the first elongated cleaning head opening adjacent a roadway surface to be swept and about a main rotary broom for vacuumized removal of airborne dust, and having a connected conveyor housing providing fluid communication between the first elongated cleaning head and the vacuum source.

24. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. a hopper for collecting dust, dirt, and debris:

d. at least a portion of the conveying mechanism in fluid communication with the vacuum source, and thereby vacuumed, and in communication with the surface cleaning head for transporting dust, dirt, and debris from the main road surface cleaning hoad to the hopper;

e. a common air filtration mechanism for substantially removing airborne dust in air drawn from the main cleaning head opening by way of the vacuum source f. the main road surface cleaning head includes an elongated rotary broom having a rotational axis substantially aligned with the surface g. said conveying mechanism is a conveyor mechanism for transporting the dirt and debris to the hopper, and where the conveyor mechanism is surrounded at least in part by a vacuumized housing having an open end in communication with the main road surface cleaning head, and a second open end in communication with the hopper h. wherein the main road surface cleaning head includes a pressurized air inlet and an air outlet whereby debris entrained with and carried along by the air being conducted through the main road surface cleaning head exits therefrom through the conveying mechanism;

i. the conveying mechanism is an air conduit for transporting any dirt and debris to the hopper;

j. an air intake plenum having one or more first inlet ports in communication with an air chamber formed by the hopper and a plenum air exit port in communication with the vacuum source;

k. the air filtration mechanism is mounted within, at least in part, the air plenum and includes a mechanism for loosening any dirt therewith to fall with gravity; and the air plenum includes an adjustable bottom portion open to the hopper in a first configuration, and substantially closed relative to the hopper in a second configuration, so that any loosened dirt may fall into the hopper when the adjustable bottom portion is in the first configuration.

* * * * *